US007267528B2

(12) United States Patent
Hsu et al.

(10) Patent No.: US 7,267,528 B2
(45) Date of Patent: Sep. 11, 2007

(54) PLASTIC STEEL BEARING FOR BLADE ROTOR SHAFT OF COOLING FAN

(75) Inventors: Chung-Yung Hsu, Taoyuan (TW); Kuo-Ying Wu, Taoyuan (TW)

(73) Assignee: Tek-Chain Development Inc., Taoyuan (TW)

( * ) Notice: Subject to any disclaimer, the term of this patent is extended or adjusted under 35 U.S.C. 154(b) by 682 days.

(21) Appl. No.: 10/748,275

(22) Filed: Dec. 31, 2003

(65) Prior Publication Data

US 2005/0147511 A1 Jul. 7, 2005

(51) Int. Cl.
*F03B 11/06* (2006.01)

(52) U.S. Cl. ..... 415/229; 416/174; 416/209

(58) Field of Classification Search ..... 415/170.1, 415/229; 416/174, 244 R, 209; 384/275
See application file for complete search history.

(56) References Cited

U.S. PATENT DOCUMENTS 6,699,020 B1 * 3/2004 Lin ..... 417/354
6,926,497 B2 * 8/2005 Lin et al. ..... 415/213.1
2003/0108260 A1 * 6/2003 Chuang ..... 384/275

* cited by examiner

*Primary Examiner*—Edward K. Look
*Assistant Examiner*—Dwayne J White
(74) *Attorney, Agent, or Firm*—Troxell Law Office, PLLC

(57) ABSTRACT

A bearing structure for the blade of cooling fan, comprises a hollow cylindrical body and an outward extended seat whose diameter is larger than the body. The seat has a recess at the bottom. The body forms a long cavity and upward flange. This bearing is placed in the hub of the cooling fan; the blade rotor shaft is inserted into the cavity of the bearing, and the flange of the body works as a C-clamp buckling the round groove on the blade rotor shaft to confine the motion of the rotor shaft. The bearing design renders easy fabrication and assembly, good dust shield to keep the dust off the rotor and reduce the rotary friction and resistance to the minimum. In addition, the magnetic force is limited for the self-adjustment, which further alleviates the frictional resistance sop the service life the cooling fan is extended longer.

4 Claims, 5 Drawing Sheets

PLASTIC STEEL BEARING FOR BLADE ROTOR SHAFT OF COOLING FAN

FIELD OF THE INVENTION

This invention concerns the cooling fan, in particular, the bearing for the blade rotor shaft.

BACKGROUND OF THE INVENTION

The bearing structure for conventional cooling fan main comprises a bearing, oil seal, washer, C-clamp and other parts, it usually takes great time, labor and cost to assemble. Under long time use, the bearing will produce mechanical noise, or runs not smoothly and the service life is therefore shortened substantially. Now there emerges a named "Efficient bearing" as shown in FIG. 5 which proclaims less parts required in assembly.

The "efficient bearing" as shown in FIG. 5, the leading edge of body 11' grows into the localized flange 12' with a round project 13'. The bearing 1' is placed in the hub of the cooling fan. The base 2' of cooling fan has an upward sleeve 21' and the rotor winding 22' encircles the sleeve 21'. The rotor shaft 25' mounted on the hub 24' of the blade 23' can be threaded downward into the sleeve 21' and inserted downward into the bearing 1'. By the semicircular parts of the lower end of the rotor shaft 25' conduced to round tip 26' which forces the localized flange 12' stretching outward. After the round tip 26' of the rotor shaft 25' passes the localized flange 12', the round project 13' of the localized flange 12' insert the groove 27' of the rotor shaft 25. The round tip 26' will rest in the recess 31' of the seat 3' so the seat 3' seals the base 2' of the blade 23'.

This forms a complete assembly of the blade assembly.

In this prior art of the bearing structure, it requires the seat 3' to seal the opening of the base 2'. Although, the recess 31 of the seat 3, with the semicircular parts of the lower end of the rotor shaft 25' conduced to round tip 26', and provide support for the down edge of blade 23', but, this bearing design including the body 1' and seat 3' leaves room for improvement.

The repulsive force jointly produced by the permanent magnet 4' contained in the hub 24' of the blade 23' and the rotor winding 22' pushes the blade 23' to rotate and the blade 23' will float up and down in the appropriate room and maintain the proper displacement to gain self-adjusted balance. The round project 13' of the localized flange 12' retains closely on the groove 27' of the rotor shaft 25', while the blade 23' is rotating, the round project 13' of the localized flange 12' will confines the up and down displacement of the blade 23'. The tight contact of the round project 13' and the groove 27' generates great abrasive resistance, which not only destabilizes the smooth operation of the blade but also shortens the service life.

SUMMARY OF THE INVENTION

The main object of this invention is to provide a simplified, precise, easy to assemble and less friction "bearing structure".

To achieve the above object, the bearing provided this invention has an integrally formed hollow cylindrical body and an outward extended seat with larger diameter than the body. The center of the upper body is a hollow cavity with extended flange and project. The rotor shaft will enter the cavity and the project of the flange will retain on the round grove of the rotor shaft.

This design simplifies the bearing structure where the seat forms an upward cone to be pressed into the inverted groove of the base of the blade. The rotor shaft, after entering the cavity, is first retrained by the project retaining on the round groove and the C clamp at the lower end permitting the blade floating up and down within a limit space. The tiny clearance maintained between the project and the groove optimizes the self-adjusted balance of the repulsive force coming from the rotor winding. The project is design to keep away the dust falling into the cavity so as to lengthen the service life.

The bearing is made of the plastic steel material instead of the ball bearing, which stands out the following advantages:

1. The integral formation design is easy for production.
2. Lightweight—the plastic steel material takes the place of steel ball bearing.
3. No lubrication—the plastic steel material is self-lubricated.
4. Low noise—the plastic steel bearing is designed with special feature, durable and low friction and low noise.
5. Longer service life—the plastic steel material has high abrasive, strength and withstands long time use.
6. Easy assembly—an integrally form part, easy for assembly and disassembly.
7. Maintenance free—the self lubricated plastic steel is maintenance free.
8. Low production cost—comparing with the ball bearing, the plastic steel bearing saves ¾ in parts and ⅔ in labor, easy to automated assembly, and reducing the product cost greatly.

DETAILED DESCRIPTION OF THE INVENTION

Figure 1:
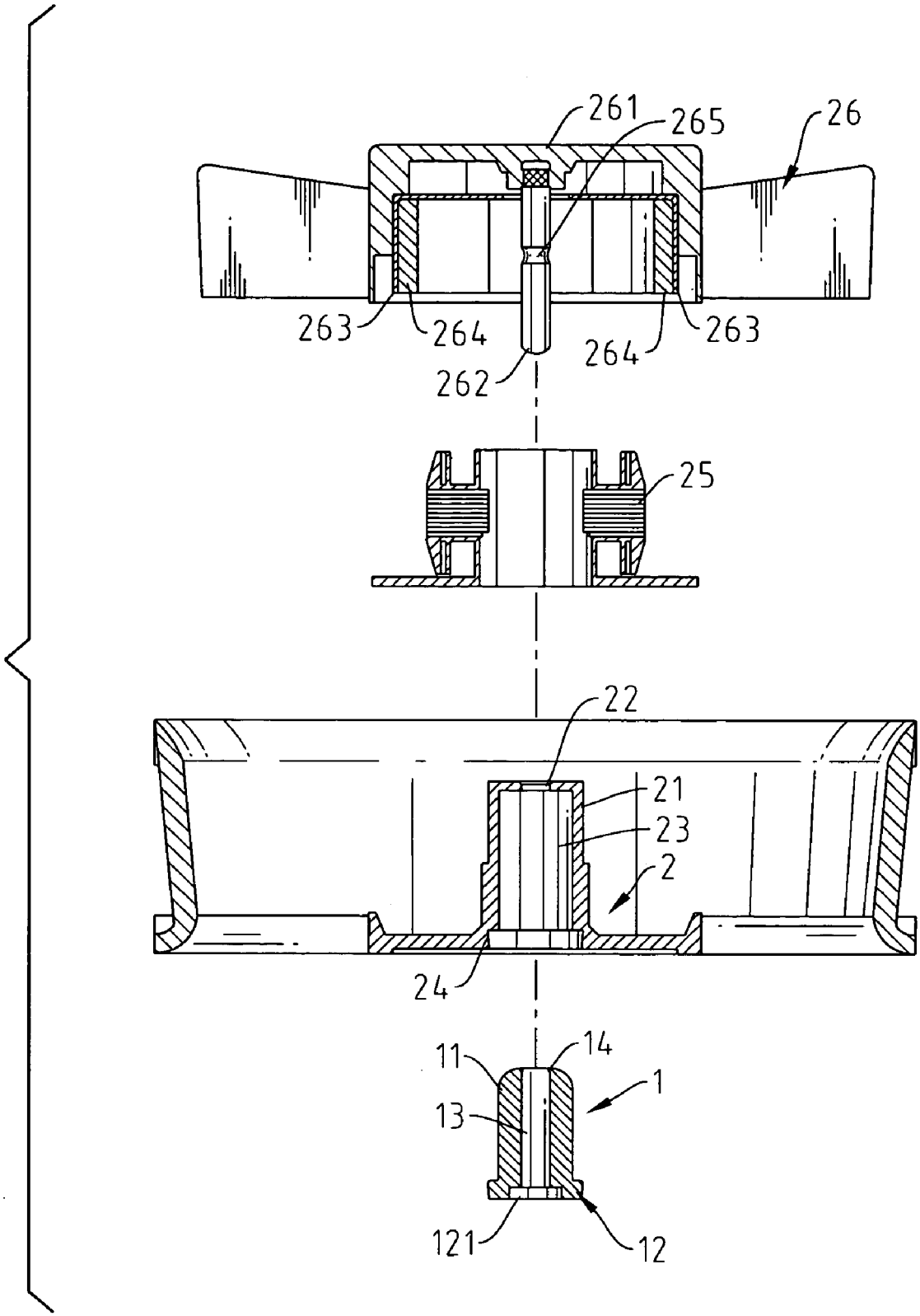
FIG. 1 shows the disassembly of the bearing of the invention.

As shown in FIGS. 1 through 4, the bearing 1 for the blade rotor shaft of the cooling fan developed by this invention is made of the plastic steel material.

Which is in the form of hollow cylindrical body 11 with an outward extended seat 12 having a diameter larger than the body 11. The seat has a recess 121 and body has a cavity 13 with upward flange 14.

The seat 12 is skew cone swelling from bottom and upward to the top.

The cavity 13 is a go-through hole linked to the recess 121.

Figure 2:
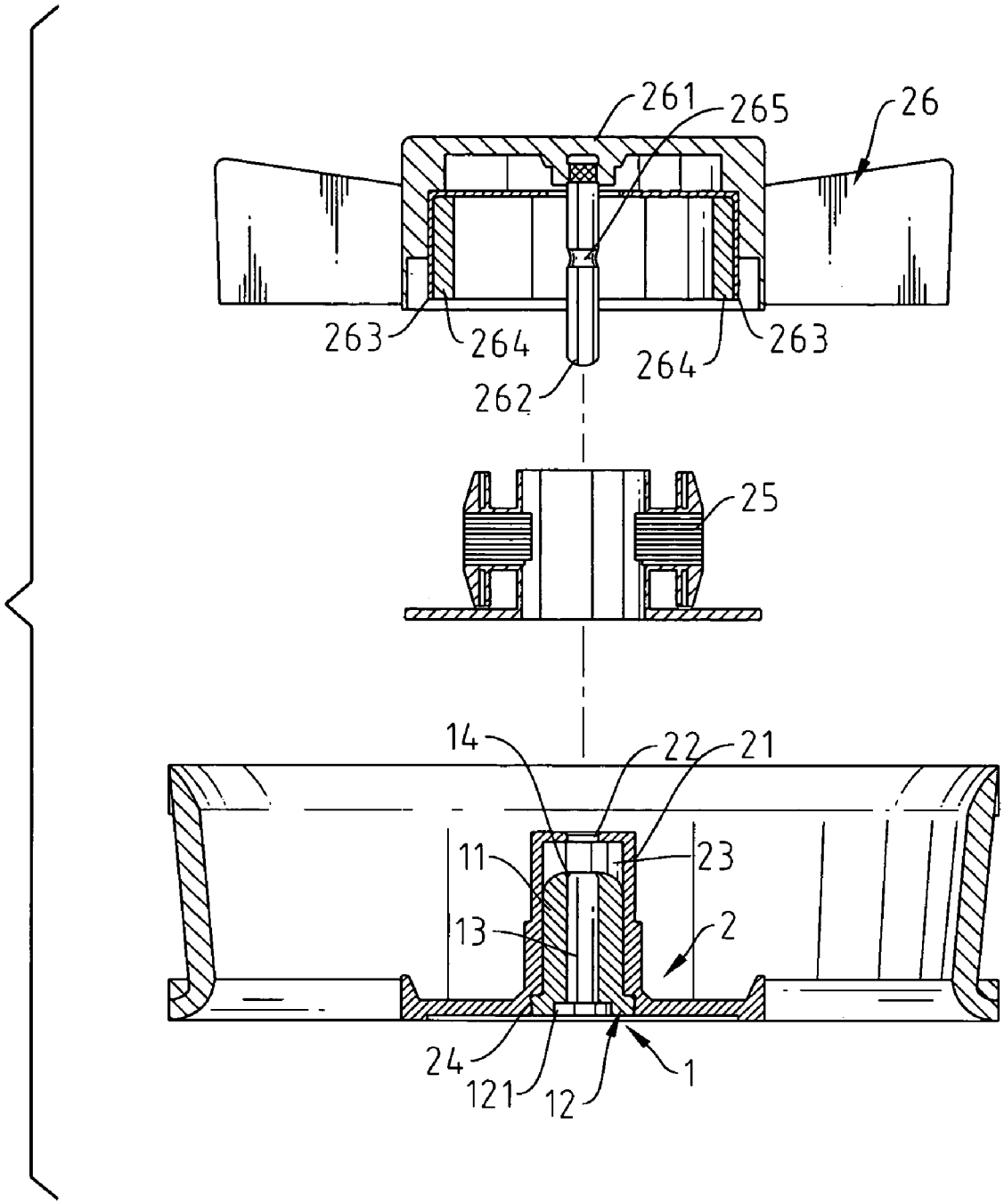
FIG. 2 shows the bearing installed on the base of the blade.
Figure 3:
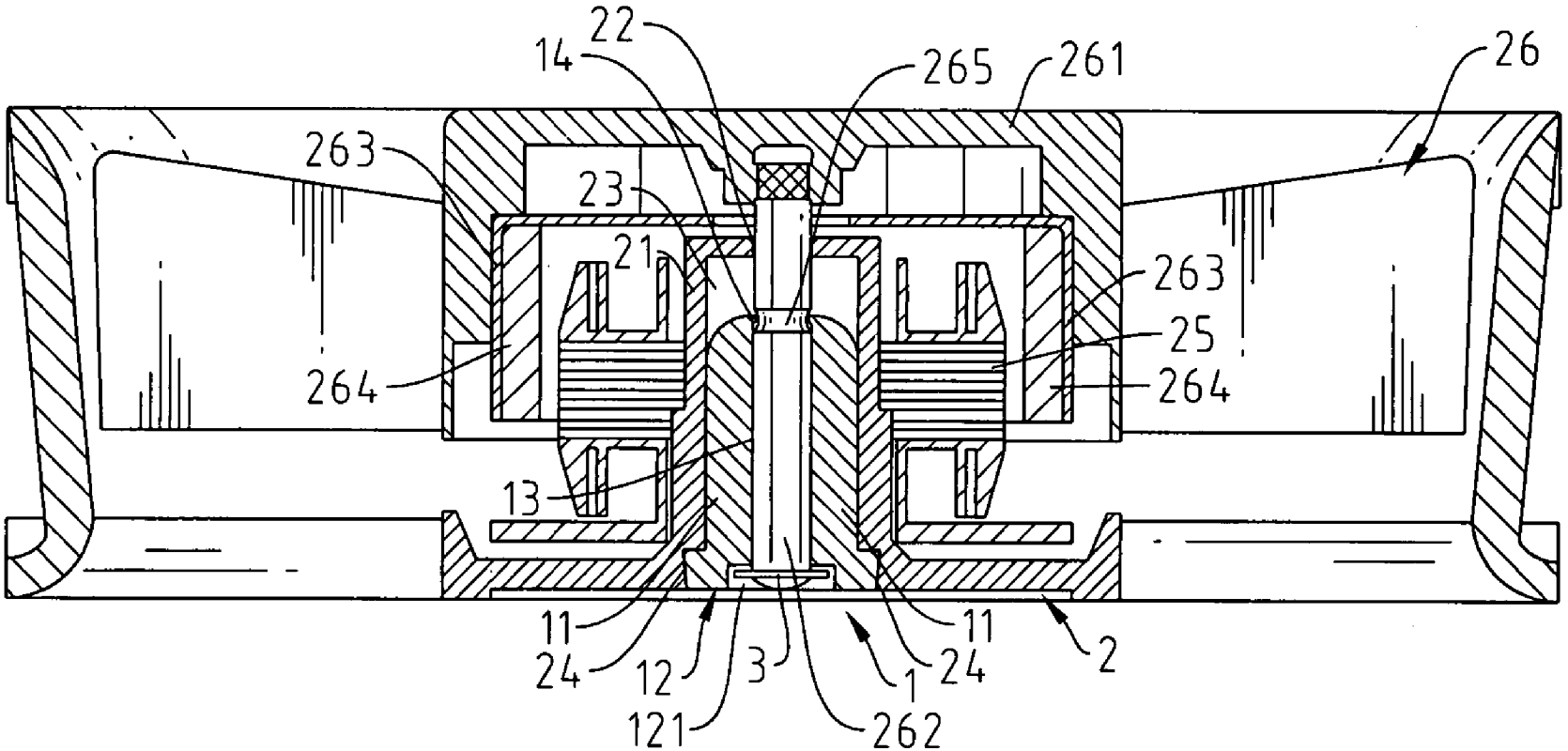
FIG. 3 shows the section of a complete assembly of the cooling fan of the invention.

As shown in FIGS. 1 through 3, the base 2 of the frame in cooling fan has a sleeve 21, a boring 22 on the top sleeve 21, a content space 23 and an inverted groove 24. The inverted groove 24 has narrow mouth but a wide bottom, just the size to receive the skew cone of the seat 12. The sleeve 21 is enveloped by the rotor winding 25. In the center of the hub 261 of the blade 26, there extends down ward a rotor shaft 262. Within the hub 261, there are a motor casing 263 and the permanent magnet 264. The rotor shaft 262 has an indented round groove 265 for resting the flange 14 when the rotor shaft 262 enters into the cavity 13 of the seat 12.

As shown in FIG. 2, the bearing 1 is inserted by force upward into the sleeve 21 of the base 2 and the body 11 is housed in the content space 23. After the seat 12 is pressed into the inverted groove 24, the inverted groove holds the seat 12 firmly in place.

Figure 4:
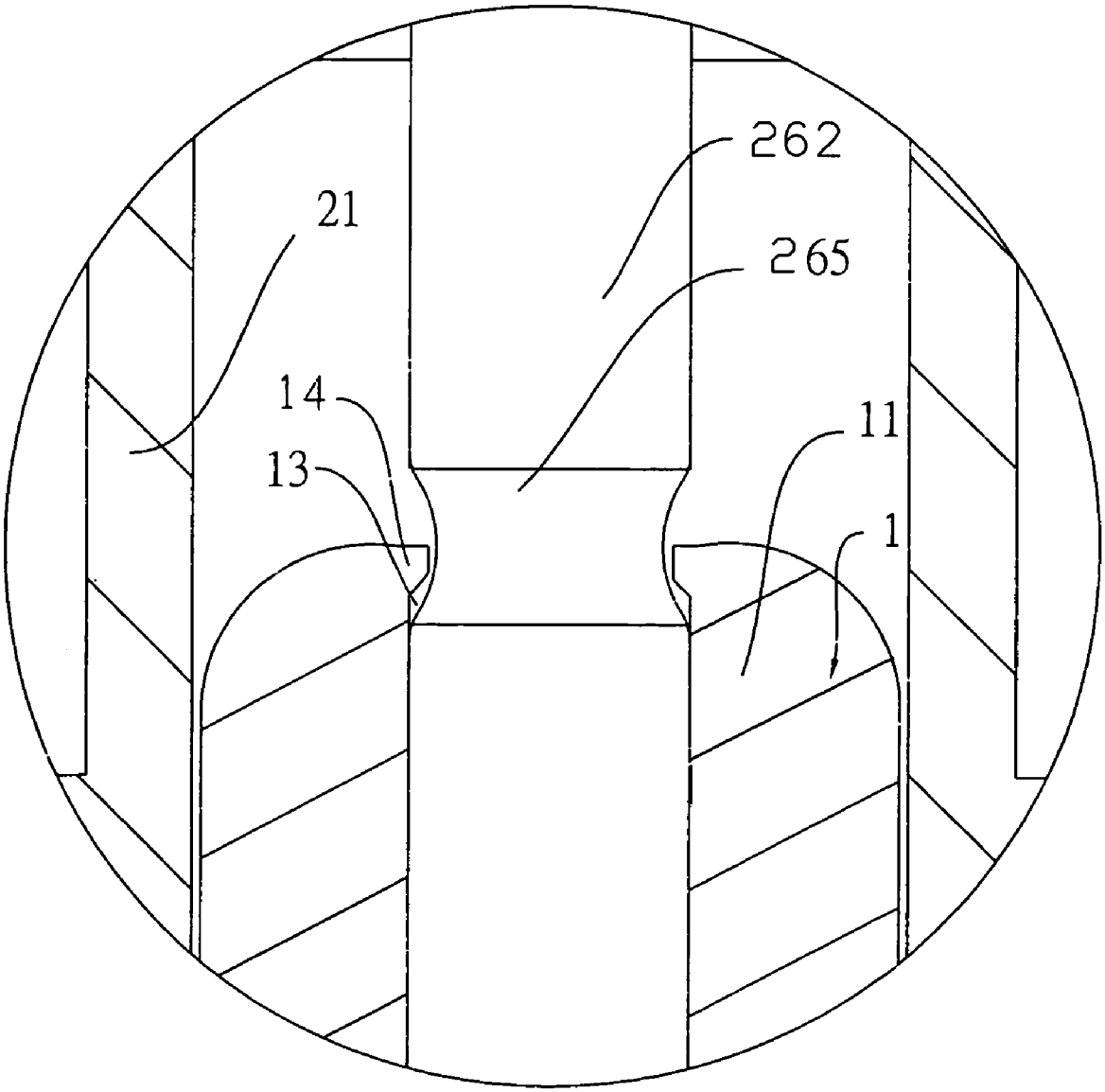
FIG. 4 shows enlarged part and profile of bearing and rotor shaft.
Figure 5:
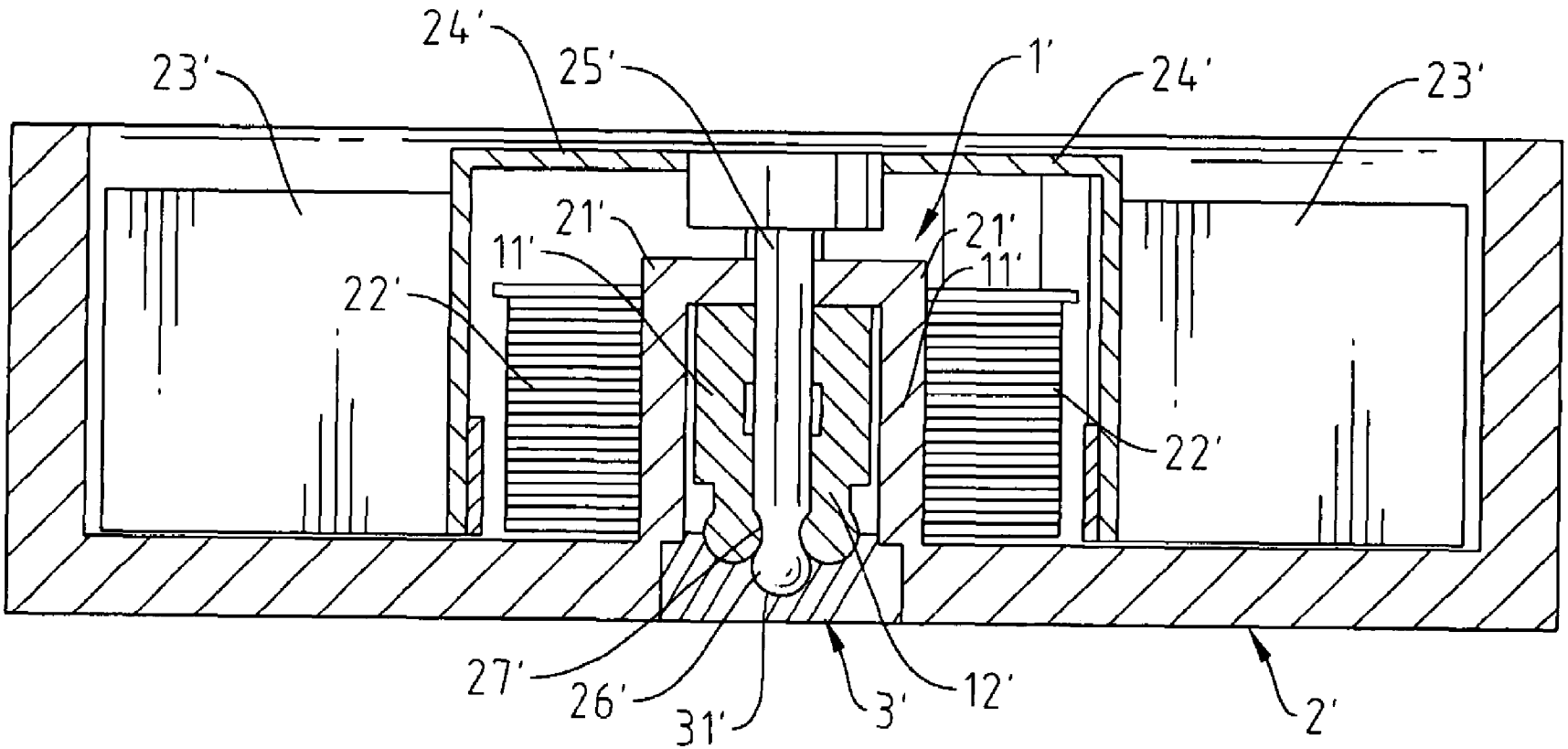
Fig. 5 Prior Art
FIG. 5 shows the section of bearing assembly in the prior art of cooling fan.

As shown in FIG. 3, the rotor winding 25 encircles the external of sleeve 21. When the rotor shaft 262 of the blade 26 pierces downward into the cavity 13 of the bearing 1 until the flange 14 catches on the round groove 265 of the rotor shaft 262, but keeps a tiny clearance as shown in FIG. 4. Finally insert the C-clamp 3 to buckle with rotor shaft 262 through the recess 121 to complete the assembly.

After the rotor shaft 262 enters the cavity 13 of the bearing 1, the flange 14 catches the round groove 265 and the C-clamp 3 is inserted in place. The rotor shaft 262 enters the cavity 13 and displaces up and down within a limited distance in the round groove 265. When the power is turned on, the rotor winding 25 is excited, the magnet 264 reacts with a repulsive force, causing the rotor shaft to rotate, at this moment the blade 26 will continue rotating and gradually reaching the balance.

It is well learned the fact that this bearing 1 is an integral form design, easy for production and assembly. The flange 14 of the cavity 13 buckled in the round groove 265 of the rotor shaft 262 retains the displacement of the rotor shaft 262, and avert the blade 26 depart in the rotating. Also, the flange 14 works a dust shield to prevent the dust falling into the cavity 13, effectively reducing the friction resistance of the rotor shaft 262. Since the rotor shaft 262 is retrained to float within short distance, easy to reach balanced rotation in short time.

The bearing structure of this invention provides a precise design, easy production and assembly, effective reduction of friction resistance and noise, and self-lubrication. These advantages excel the prior art of bearing for the cooling fan.

The invention claimed is:

1. A bearing structure for a blade of a cooling fan, made of plastic material, comprising: a hollow cylindrical body and an outward extended seat whose diameter is larger than the body, the seat has a recess and the body has a cavity, the border of the cavity extends upward to form a flange; when the bearing is installed in the blade, a rotor shaft enters the cavity, the flange buckles a round groove on the rotor shaft to restrain the displacement of the rotor shaft, and a C-clamp is inserted to limit hold the upper limit of the rotor shaft.

2. The bearing structure for the blade of the cooling fan as claimed in the claim 1, wherein the seat is skew cone swelling upward.

3. The bearing structure for the blade of the cooling fan as claimed in the claim 1, wherein the cavity is a go-through hole linked to the recess in the seat.

4. The bearing structure for the blade of the cooling fan as claimed in the claim 1, wherein the cavity border extends upward to form flange which buckles the round groove of the rotor shaft and restrain the displacement of the rotor shaft with a fixed distance.

* * * * *